United States Patent [19]

Menendez

[11] 4,135,255

[45] Jan. 23, 1979

[54] PRE-ASSEMBLED BIDET ATTACHMENT

[76] Inventor: Jorge Menendez, P.O. Box 420496, Miami, Fla. 33142

[21] Appl. No.: 797,554

[22] Filed: May 16, 1977

[51] Int. Cl.[2] ..... A47K 3/22; A47K 11/08

[52] U.S. Cl. ..... 4/7; 4/6

[58] Field of Search ..... 4/6, 7

[56] References Cited

U.S. PATENT DOCUMENTS

| | | | |
|---|---|---|---|
| 3,513,487 | 5/1970 | Palermo et al. | 4/7 |
| 4,041,553 | 8/1977 | Sussman | 4/7 |

*Primary Examiner*—Henry K. Artis

*Attorney, Agent, or Firm*—Samuel Lebowitz

[57] ABSTRACT

A pre-assembled, low-cost, bidet or body cleansing attachment for a toilet bowl, which may be purchased by the consumer for mounting on a toilet bowl, which may be purchased by the consumer for mounting on a toilet bowl for selective manual positioning so that the spray nozzle of the unit may function as a body washer, or if this is not desired, it may be shifted into an inoperative position below the toilet seat so that the nozzle is beyond the path of body wastes and in position to be cleansed repeatedly by the flushing waters in the toilet bowl. The movable spray pipe may be swung completely out of the toilet bowl into a vertical position on the side and at the rear of the toilet bowl. The assembly is furnished with flexible plastic water pipes and water diverting clamps mounted thereon to permit the average consumer to connect the assembly to the hot and cold water supplies in the average bathroom without need for the services of a plumber.

4 Claims, 7 Drawing Figures

Fig. 1
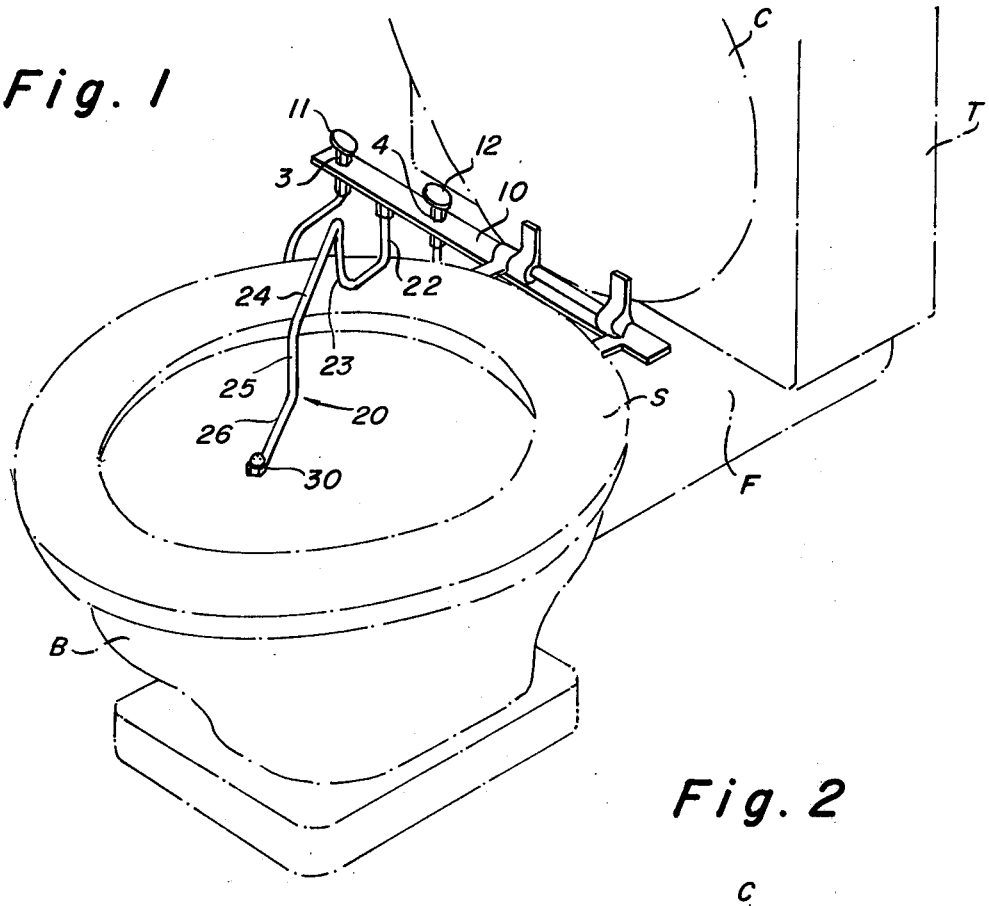
Fig. 2
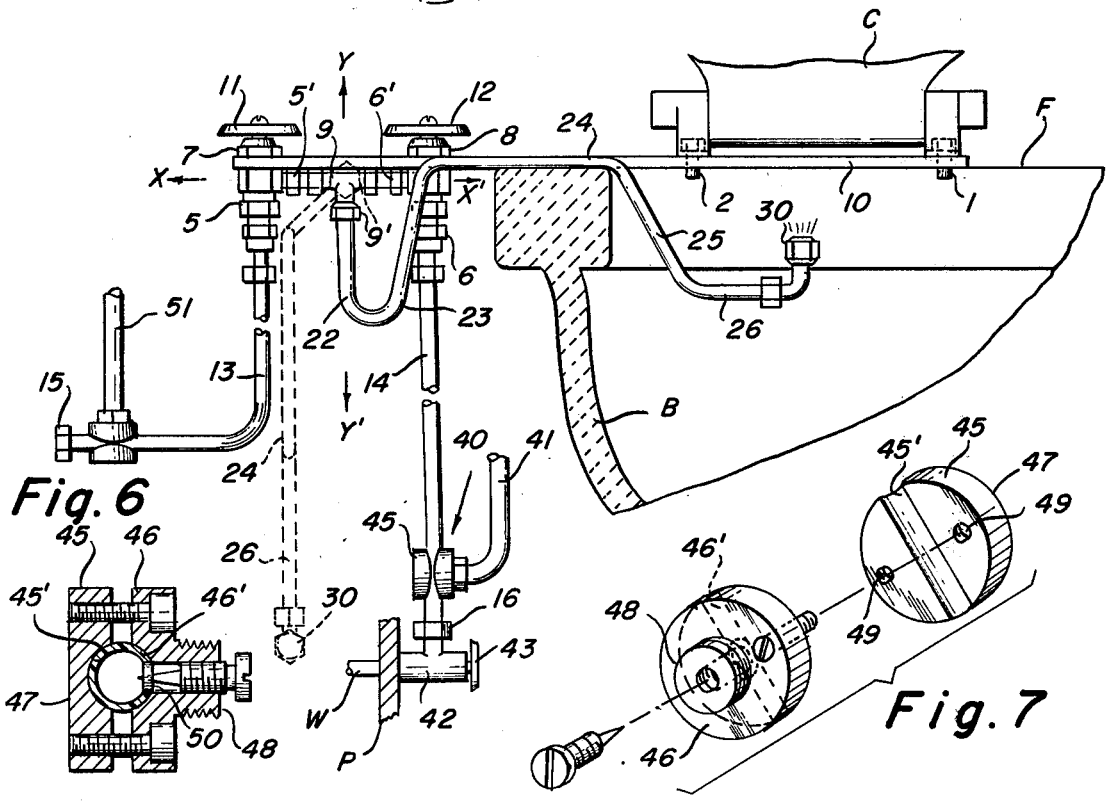
Fig. 6
Fig. 7

PRE-ASSEMBLED BIDET ATTACHMENT

This invention relates to a pre-assembled, low-cost, bidet attachment for toilet bowls which may be mounted and connected to the water supply without need for a plumber.

It is an object of the present invention to provide a simple and rugged bidet assembly of comparatively few parts and consequently of low cost, so that the average consumer desirous of the facility of the bidet attachment as an adjunct to a toilet bowl, may enjoy this convenience without entailing extensive costs for either the equipment or the installation thereof.

It is another object of the invention to provide a bidet attachment to a toilet bowl which is rapidly manipulatable between its operative and inoperative positions, so that the user may enjoy this convenience at any time and thereafter shift it to an inoperative position where it is maintained hidden from view and in a clean condition until it is ready for a repeated use.

It is another object of the invention to simplify the constructions known generally in the art and as disclosed in many patents such as those which have issued to Guidetti, of which U.S. Pat. No. 1,988,078 is illustrative, and U.S. Pat. Nos. 1,663,111, Mar. 20, 1928, and 3,513,487, May 26, 1970.

Other objects and purposes will appear from the detailed description of the invention following hereinafter, taken in conjunction with the accompanying drawings, wherein FIG. 1 is a perspective view of the bidet assembly in accordance with the invention for mounting on a toilet bowl, indicated in dotted lines;

FIG. 2 is a partial transverse vertical sectional view of the toilet bowl with the bidet assembly in operative position shown in elevation, in solid lines, and in inoperative position outside the toilet bowl, in dotted lines;

Figure 3:
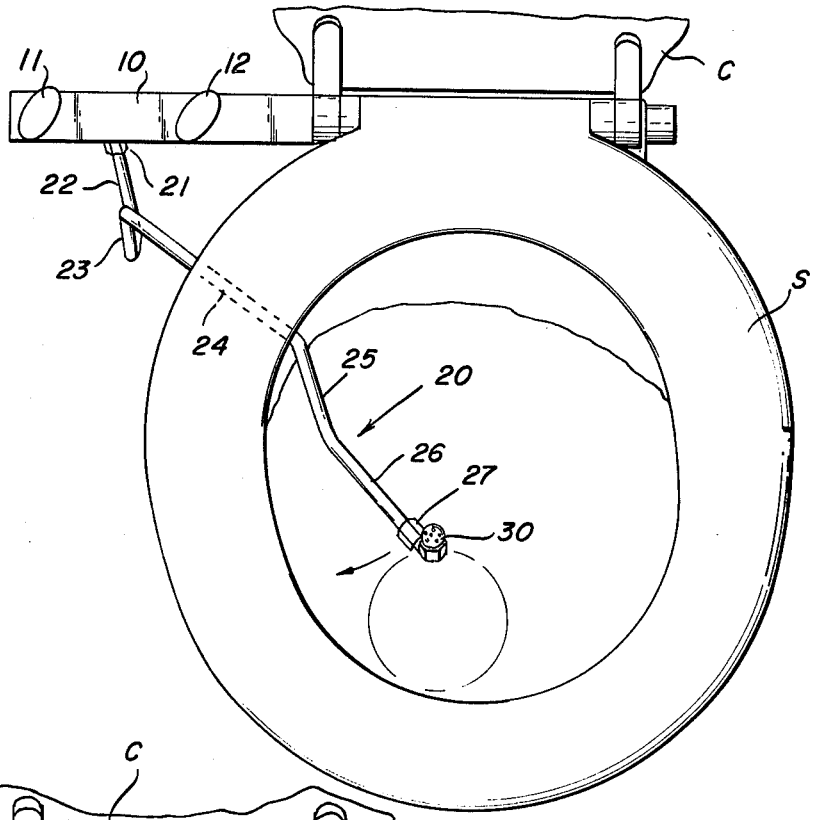
FIG. 3 is a plan view of the assembly in operative position, as shown in FIG. 1.

FIG. 6 is a vertical sectional view of one of the flexible tube by-pass clamps in the course of its being pierced at any desirable point along the length thereof for conducting water to the bathroom fixture; and FIG. 7 is an enlarged exploded view of the component element water-diverter clamp adapted to embrace each flexible conduit at a convenient point for the connection between it and the respective bathroom fixture.

The drawings illustrate the simplified bidet attachment which may be pre-assembled and furnished with flexible plastic pipe connections so that the purchaser may mount the same on a toilet bowl and connect the attachment to the water supply without need for the specially skilled help of a plumber. In fact, the assembly is made up of so relatively few parts that the cost thereof involves little more than the minimal charge of a plumber's service call. The assembly in accordance with the invention is mounted upon a bar 10 which is provided with four openings. Two of these openings, 1 and 2, which are adjacent to one end of the bar, are adapted to receive the fastening bolts for pivotally mounting the toilet seats and cover C on the rear flange F of the bowl. Openings 3 and 4, adjacent the opposite end of the bar, are adapted to receive valve units 5 and 6, respectively, which are clamped to the bar by clamping nuts 7 and 8 on the upper surface thereof, and from which protrude control handles 11 and 12, respectively.

The valve units may be fabricated in any desired manner, for example, as disclosed in U.S. Pat. No. 3,417,570, and a mixing conduit 9, with threaded connectors including an intermediate T-connection, extend between the valve units, all disposed below the lower surface of the bar 10, and are virtually invisible from a standing position in front of the toilet bowl.

The valve units 5 and 6, formed of chrome-finished brass, are fitted with lateral bushings 5' and 6' which provide support for the opposite ends of a T-shaped mixing conduit or coupling 9 so that it may rotate freely on the horizontal axis X—X'. The extent of rotation is approximately 180° and is limited by the connecting bushing 9' striking against the opposite edges of the bar 10.

Lengths of flexible plastic tubing 13 and 14, of a size commonly used in bathroom conduit connections, having an external diameter of ⅜", extend from the lower end of the valve units 5 and 6 and are connected to the water supply system in a manner described hereinafter.

Figure 4:
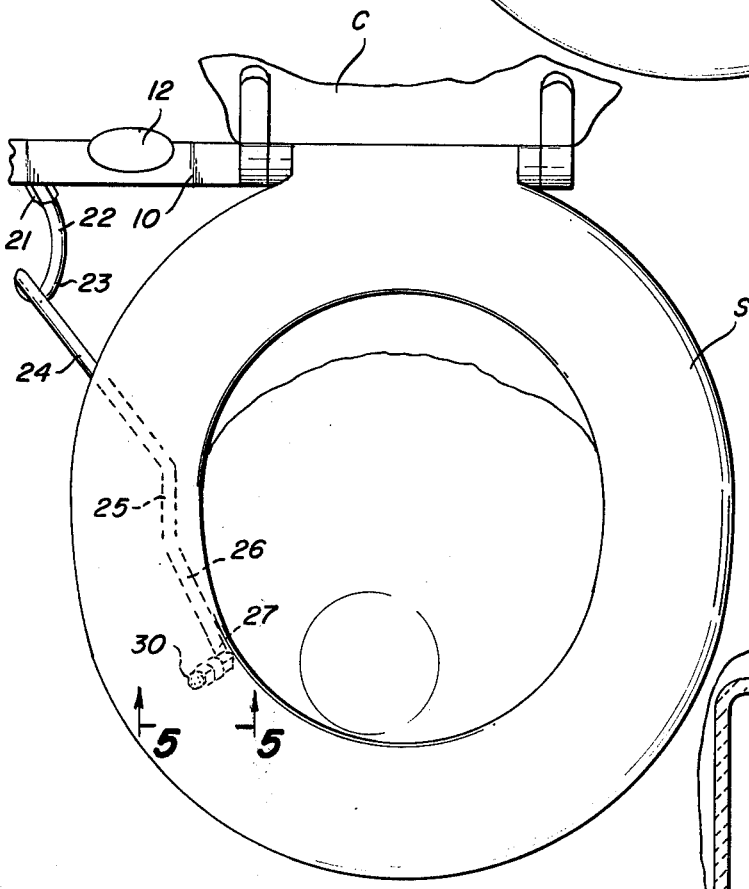
FIG. 4 is a plan view of the assembly with the spray nozzle in inoperative position.
Figure 5:
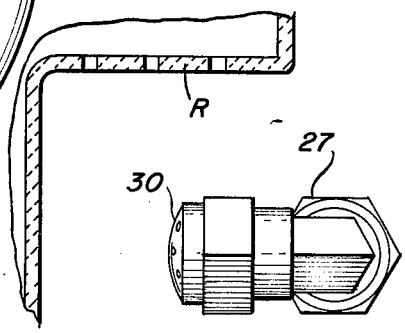
FIG. 5 is a sectional view along line 5—5 of FIG. 4.

A specially contoured conduit 20, of chromium plated tubing, of approximately ⅜" external diameter, has its inlet end 21 pivotally connected to the outlet of the T-connection in the mixing conduit 9, and its outer end terminates in the spray nozzle 30. The connecting bushing 9' between said inlet end and T-outlet permits rotary movement of the conduit 20 around the vertical axis Y—Y' to an extent of approximately 135°, which is limited by the downwardly extending portions of the valve units. The inlet end has a U-shaped outline 22, 23, wherefrom the horizontal portion 24 extends across the upper rim of the toilet bowl and is bent downwardly at 25 and horizontally at 26, whereat is pivotally mounted the spray nozzle 30 by means of coupling nut 27. The horizontal portion 23 adjacent to the inlet end 21 and 22 provides a simple handhold for the movable unit 20 to shift the same from the operative position of the unit, as shown in FIGS. 1 and 3, to its inoperative position adjacent the left side of the rim and below the inner edge of the toilet seat, as shown in FIG. 4. No special control handles are required to shift the unit 20 from these alternative positions. Furthermore, the spray nozzle 30 is readily movable from its operative position shown in FIGS. 1, 2 and 3, at which time the spray of water issuing therefrom is directed upwardly, to an inoperative position when the spray nozzle is adjacent to the rim, along a horizontal axis and in position to be sprayed by the flushing waters issuing from the underside of the rim R to the toilet bowl, (FIG. 5). Thereby, the assembly is maintained in an inconspicuous position below the toilet seat and beyond the range of body wastes, and is repeatedly subjected to the cleansing waters issuing from the rim during periods of repeated flushings. Whenever it is desired to utilize the attachment for cleansing the lower portions of the body, while sitting on the toilet seat, the unit 20 is manipulated easily by grasping the exposed portion of the horizontal arm 24 and the U-shaped terminal 22 and 23 to shift the unit from its position shown in FIG. 4 to that shown in FIG. 3. The temperature and the force of the water issuing from spray nozzle 30 may be controlled conveniently by manipulating the valve handles 11 and 12.

The cleansing unit may be removed from the bowl completely into the position shown in dotted lines in FIG. 2 towards the rear and side of the toilet bowl. This may be done by raising the seat S and thereafter swinging the spray conduit 20 upwardly around the axis X—X' when it is in any position between those shown in FIGS. 3 and 4. This rotary motion is permitted by the U-shaped inlet end adjacent to the bar 10. The spray conduit in its raised position is rotated in a counterclockwise direction on its axis Y—Y' so that it may clear the side of the toilet bowl in the course of its return downward movement to assume its inoperative position adjacent to conduit 13 as shown in dotted lines in FIG. 2.

The self-contained and assembled unit with the flexible tubes 13 and 14 extending from the valve units 5 and 6 may be connected easily to the water supplies in the bathroom by means of the terminal connectors 15 and 16, respectively, and the specially designed clamp assemblies 40 mounted on the flexible tubes 13 and 14. The two clamp assemblies are identical and only one of these units will be described in detail. Because the flush tank T is always in close proximity to the toilet bowl, the flexible conduit 14 is generally of shorter length, for example, about one foot, and the terminal connector 16 is connected to the water supply leading to the flush tank. Thus, as shown in FIG. 2, the rigid cold water conduit 41 leading from the cut-off valve 42 for the water supply pipe W extending through the partition P, is disconnected from the valve 42 after, of course, shutting off the water supply by control handle 43. The terminal connector 6 of the flexible conduit 14 is now connected to the cut-off valve 42 at the nipple which previously was coupled to rigid pipe 41, so that now cold water is fed to the bidet attachment and controlled by the valve handle 12.

The clamping assembly 40, positioned at some convenient point along the length of tube 14, is formed of two discs 45 and 46, each provided with a diametral groove 45', 46', respectively, of slightly less than one-half of the diameter of the flexible tube 14 and facing each other to embrace the latter therebetween. The outer face 47 of disc 45 is smooth and a threaded lug 48 projects from the center of the outer face of disc 46. A pair of bolts 49 with the heads thereof countersunk in disc 46 and passing freely through openings in the latter, engage threaded openings 49 in disc 45, to clamp the two discs together in tight engagement with tube 14. The externally threaded lug 48 projects from the outer surface of disc 46 and is of a size corresponding to that of the nipple of the cut-off valve 42, to which the inlet of conduit 41 was connected previously. This inlet is connected to lug 48 after tube 14 is pierced to allow water to be shunted from the latter for flow through lug 48 and conduit 41 connected thereto.

The piercing may be executed by advancing a pointed tool through the central opening in disc 46 to the interior of tube 14.

An annular washer 50 of flexible material, is seated on the inner face of the groove 46' in surrounding relation to the central bore in disc 46, so that no leakage takes place around the pierced opening in flexible tube 14. Upon opening the cut-off valve 42, cold water is fed to inlet end 16 of tube 14, and thence through the externally threaded lug 48, to which is connected the inlet end of the tubing 41, which leads to the bottom of the water supply tank, as well as to the valve unit 6 of the bidet attachment.

A similar by-pass connection is made adjacent the terminal connector 15 of the flexible tube 13, which is similarly connected to the hot water supply, and which may be led to the hot water faucet of the lavatory in the bathroom by conduit 51. The clamp assembly 45, 46 applied to this flexible tube serves to divert the hot water leading from the hot water supply to the hot water faucet in conjunction with the hot water passing to the valve unit 5 of the bidet assembly for control by the hot water control valve 11.

In those cases where the coupling to the hot water connection by means of conduit 13 is impractical, the economies of the invention are still attainable by plugging up valve unit 5 and using the cold water supply only.

In some cases it may be more desirable to maintain intact the existing water connections between the water supplies and bathroom fixtures, i.e., the flush tank and the hot water faucet of the lavatory. In such situations the flexible plastic tubes 13 and 14 are connected to the divering clamps mounted on the water conduits, which, of course, must be pierced at the interior of the threaded lugs 48.

I claim:

1. A pre-assembled bidet attachment to a toilet bowl, comprising a. an integral bar provided with a pair of openings adjacent to one end thereof for mounting on the rear flange of the toilet bowl in conjunction with the toilet seat and cover therefor, b. said bar having a pair of openings adjacent to the opposite end thereof for mounting the bidet assembly thereon, c. said assembly comprising d. a pair of valve units extending through said last-mentioned openings, each terminating in a control handle above said bar and a coupling to a water supply below said bar, e. a rigid T-shaped coupling having the opposite inlet ends thereof mounted below said bar between said valve units for rotation around a horizontal axis and an outlet nipple at the mid-portion thereof.

f. a rigid adjustable conduit terminating in an upwardly directed U-shaped portion having the outer arm thereof rotatably mounted on said outlet nipple around an axis transverse to said first-mentioned axis and its inner arm merging into a substantially horizontal conduit portion adapted to overlie the upper lateral edge of the toilet bowl and another portion bent downwardly and then outwardly in the same direction as said horizontal portion, and g. a spray nozzle connected to the outlet of said outer portion, adapted to assume alternate positions at substantially the center of the toilet bowl and at said lateral edge adjacent to the flushing rim thereat solely by the manual manipulation of said adjustable conduit, h. said adjustable conduit also adapted to swing around said horizontal axis from within the toilet bowl to a position thereabove followed by a rotary movement around said transverse axis and a return movement around said horizontal axis to position said conduit and nozzle in a downward direction, laterally and behind the toilet bowl.

2. An assembly as set forth in claim 1, including flexible plastic conduits between said couplings of said valve units and the hot and cold water supplies in proximity to said toilet bowl.

3. An assembly as set forth in claim 1, wherein said spray nozzle is rotatably mounted to the outlet of said outer portion to assume alternate positions, in a vertical direction when it is disposed in its operative position at the center of the toilet bowl, and in a horizontal direction in its inoperative position below the flushing rim to effect a cleansing thereof.

4. An assembly as set forth in claim 3, wherein the spray nozzle, in its horizontal direction, is directed towards the lateral wall of the toilet bowl.

* * * * *